US008678221B2

(12) United States Patent
Thiemann et al.

(10) Patent No.: US 8,678,221 B2
(45) Date of Patent: Mar. 25, 2014

(54) BEVERAGE CONTAINER LID WITH MOUTH OPENING AND SEPARATE PUSH IN VENT

(75) Inventors: Daniel Alan Thiemann, Toronto (CA); Ray Alan Toms, Golden, CO (US)

(73) Assignee: Crown Packaging Technology, Inc., Alsip, IL (US)

( * ) Notice: Subject to any disclaimer, the term of this patent is extended or adjusted under 35 U.S.C. 154(b) by 547 days.

(21) Appl. No.: 12/769,010

(22) Filed: Apr. 28, 2010

(65) Prior Publication Data

US 2011/0266281 A1 Nov. 3, 2011

(51) Int. Cl.
*B65D 17/34* (2006.01)

(52) U.S. Cl.
USPC ..... 220/271; 220/231; 220/254.2; 220/254.3; 220/254.4; 220/266; 220/268; 220/270; 220/267.1; 220/906; 215/370; 215/902; 222/478

(58) Field of Classification Search
USPC ..... 220/231, 254.2, 254.3, 254.4, 266, 268, 220/270, 367.1, 906; 222/478; 215/370, 215/902
See application file for complete search history.

(56) References Cited

U.S. PATENT DOCUMENTS

| | | | | |
|---|---|---|---|---|
| 3,741,432 | A | 6/1973 | Werth et al. | |
| 4,134,517 | A | 1/1979 | Rhoades | |
| 5,011,037 | A * | 4/1991 | Moen et al. | 220/271 |
| D322,222 | S | 12/1991 | Coy | |
| 5,285,919 | A | 2/1994 | Recchia | |
| 5,307,947 | A | 5/1994 | Moen et al. | |
| 5,375,729 | A | 12/1994 | Schubert | |
| 5,397,014 | A | 3/1995 | Aydt | |
| 5,555,992 | A | 9/1996 | Sedgeley | |
| 5,692,636 | A | 12/1997 | Schubert | |
| 5,695,085 | A | 12/1997 | Hadener | |
| 5,860,553 | A | 1/1999 | Schubert | |
| 6,015,060 | A | 1/2000 | Rightenour et al. | |
| D437,223 | S | 2/2001 | Coy et al. | |
| 6,234,338 | B1 | 5/2001 | Searle | |
| 6,354,453 | B1 | 3/2002 | Chasteen | |
| 6,494,332 | B1 | 12/2002 | Haughton et al. | |
| 6,715,629 | B2 | 4/2004 | Hartman et al. | |
| 6,763,964 | B1 | 7/2004 | Hurlbut et al. | |
| 7,000,797 | B2 | 2/2006 | Forrest et al. | |
| 7,513,383 | B2 | 4/2009 | Hwang | |
| 7,942,285 | B2 | 5/2011 | Hasegawa et al. | |

(Continued)

FOREIGN PATENT DOCUMENTS

| | | |
|---|---|---|
| EP | 2113293 | 11/2009 |
| JP | 05-178345 | 7/1993 |

(Continued)

*Primary Examiner* — Anthony Stashick
*Assistant Examiner* — Elizabeth Volz
(74) *Attorney, Agent, or Firm* — Baker & Hostetler LLP

(57) ABSTRACT

A container lid includes a conventional main or pour opening and a vent opening spaced from the main opening. A vent score defines the shape of the vent opening, and a vent panel covers the vent opening. The vent panel has a raised convex shape. The lower surface of the tab handle includes a protruding portion, seen as a concave shaped element when viewed from above the container lid. The protruding portion of the tab handle can be aligned with the vent panel so application of a downward force on the tab handle transfers force to the vent panel and breaks the vent score. The shapes of the vent panel and concave element of the tab handle can be adjusted for selective and controlled force transfer to create the vent opening.

24 Claims, 6 Drawing Sheets

(56) References Cited

U.S. PATENT DOCUMENTS

| | | | | |
|---|---|---|---|---|
| 7,975,884 | B2 | 7/2011 | Mathabel et al. | |
| 8,196,767 | B2 | 6/2012 | Fields | |
| 2003/0038134 | A1 | 2/2003 | Chasteen et al. | |
| 2004/0140314 | A1 | 7/2004 | Li | |
| 2004/0144787 | A1 | 7/2004 | Heck | |
| 2004/0159665 | A1 | 8/2004 | Morrissey et al. | |
| 2007/0029334 | A1 | 2/2007 | Bagley | |
| 2007/0045318 | A1* | 3/2007 | Gibson et al. | 220/269 |
| 2007/0051727 | A1 | 3/2007 | Holley | |
| 2009/0065518 | A1 | 3/2009 | Carnevali | |
| 2010/0294771 | A1 | 11/2010 | Holder et al. | |
| 2011/0056946 | A1 | 3/2011 | Emanuele, III et al. | |
| 2011/0108552 | A1 | 5/2011 | Tamarit Rios | |

FOREIGN PATENT DOCUMENTS

| | | |
|---|---|---|
| JP | 05-310248 | 11/1993 |
| JP | 11348979 | 12/1999 |
| JP | 2000-185757 | 7/2000 |
| JP | 2004-042982 | 2/2004 |
| JP | 2005-343557 | 12/2005 |
| JP | 2006-347580 | 12/2006 |
| JP | 2007-320617 | 12/2007 |
| WO | WO 93/25445 | 12/1993 |
| WO | WO 2008/023983 | 2/2008 |

* cited by examiner

BEVERAGE CONTAINER LID WITH MOUTH OPENING AND SEPARATE PUSH IN VENT

FIELD OF THE INVENTION

The invention relates generally to beverage containers having an end including a main or pour opening for removing contents of the container, the main opening created by a manually operated tab attached to the can. More particularly, the invention relates to a beverage or can end having a separate vent opening formed on the can end to relieve vacuum or pressure within the container during pouring or drinking of the contents.

BACKGROUND OF THE INVENTION

There are numerous references that generally disclose beverage containers having a main or pour opening, and a separate vent opening formed on the same end panel as the main opening. The most common container, particularly for carbonated and malt beverages, is one that includes a tab to create the main opening from a scored area that surrounds a mouth portion of the end panel. The tab is typically secured by a rivet to the can end. The tab is lifted from one end, and a contact portion on the opposite end of the tab is lowered in contact with the end panel to impart a force on the mouth portion. The score is broken and the mouth portion is separated from the end panel by the force of the tab thus creating the main opening.

One example of a prior art reference disclosing a container end with a separate vent opening is the U.S. Pat. No. 5,011,037. This reference more particularly discloses a container end member having a first severable tab portion defined by a score line groove and an integral hinge for permanently securing the tab to the container. A force applying tab is mounted on the container end and is used to apply a force to the first severable tab portion to form the main or pour opening. A second severable tab portion is formed on the container end, also having an integral hinge portion for securing it to the container. The second severable tab portion has a raised surface projecting outwardly from the container end, so that a force may be more conveniently applied thereto to sever the second severable tab portion and form a vent opening in the container end.

Another example of a reference disclosing a container lid having a main opening and a separate vent opening includes the U.S. Pat. No. 5,819,973. This reference more specifically discloses a container lid having a vent tab for creating a pour opening, and also a vent hole for creating an air vent. A lift tab is pivotally mounted upon the lid. The lift tab has a handle end and an abutment end for exerting a downward force upon the panel covering the main opening. The opposite end of the handle when raised, exerts an upward force to open a vent hole rivet attached to the lift tab.

SUMMARY OF THE INVENTION

While the prior art may be adequate for its intended purpose, there is still a need for a conventional container lid or can end in which a tab is used to create the main opening, yet the tab itself can be used to also facilitate more efficient opening of a separate vent located on the container lid. There is also a need to provide a can end in which the shape of the vent panel in combination with the shape of the lower surface of the tab allows the vent opening to be created with force applied at a particular location on the vent panel, and along a particular angle to break the score of the vent panel. There is yet another need to provide a separate vent on a conventional container end without having to reconstruct the basic design and functioning of the conventional container end.

The present invention provides a beverage container lid or container end having a mouth opening, and a separate vent opening. The container lid includes an opening tab having a central portion with a rivet that connects the tab to the container lid. The main opening is conventional, in which a mouth panel is pushed inward by breaking a mouth score with a contact end of the tab. The vent opening is created by applying a force to break a vent score surrounding a vent panel. The vent panel has a portion that remains attached to the can end, while the remaining portion of the vent panel is pushed inwards towards the interior of the container. The resulting opening vents the container. Preferably, the vent panel is located on the can end at a location that prevents the vent hole from filling with liquid from the container when it is tipped during use. Additionally, the vent is preferably located so that the handle end of the tab covers the vent panel when the tab is rotated from its normal position. The vent panel is raised or protrudes with reference to the surface of the main panel of the container lid. In a preferred embodiment, the vent panel is convex-shaped, and the vent panel protrudes a desired height above the main panel of the container lid.

The tab is of a special construction including a concave area formed at the handle end of the tab. Normally, the handle end of the tab has a large opening. However, in the present invention, the opening is eliminated in favor of a concave-formed area. More specifically, the lower surface of the tab handle includes a protruding portion, seen as a concave shaped element when viewed from above the container lid. When the tab is rotated to cover the vent panel, the concave-formed area may be centered over the raised vent panel. The gap between the vent panel and tab is closed by the protruding vent panel and the complementary oppositely protruding concave area of the tab. The user presses down on the concave area of the tab to transfer force to the raised vent panel and to open the vent by breaking a vent score surrounding the vent panel. The shape of the vent panel and the shape of the concave area of the tab facilitate force transfer at a desired location and direction to most effectively create the vent opening. In another embodiment, the concave-formed area may be off-set from the raised vent panel such that the concave formed area makes contact with the raised vent panel at a location closer to a selected side of a peripheral edge of the vent panel.

In another aspect of the invention, a method is provided for opening a container and venting a container. According to the method, a tab has a pressure applying end that is used to create the main opening by breaking a score in the main opening panel, in the conventional manner. The tab is then rotated to align a concave area of the tab handle with a raised vent panel. The raised vent panel and the concave area of the tab form a bridge, so that downward pressure applied to the tab results in a force transferred to the vent panel to break a score surrounding the vent panel, and thus creating the vent opening. By selectively varying the respective shapes of the raised vent panel and concave area, along with varying their alignment with one another, allows the user to break the vent score in a controlled manner.

Additional features and advantages of the invention will become apparent from a review of the following detailed description, taken in conjunction with the accompanying drawings.

DETAILED DESCRIPTION

Figure 1:
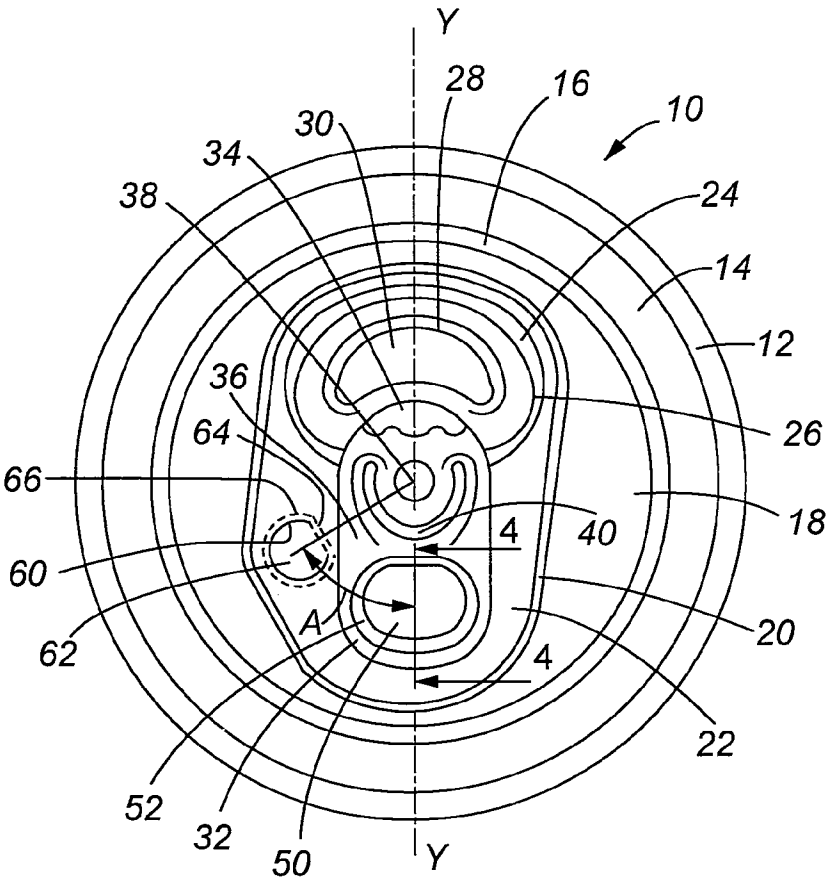
FIG. 1 is a plan view of the container lid of the present invention.

FIG. 1 shows a first preferred embodiment of the present invention including a container end 10 with a mouth or pour opening defined by a mouth panel 30, and a vent opening defined by vent panel 62. The container end 10 may include a peripheral seam or rim 12 that is secured to the cylindrical body (not shown) of the container.

Located radially inside the peripheral seam 12 is a peripheral channel or depression 14. Located radially inward of the peripheral channel may be one or more ridges or forms 16, created in a concentric arrangement as shown. Located within the ridge 16 is the main panel 18. Another ridge 20 is shown radially within the main panel 18. The most interior portion of the lid is defined by a depressed or lowered interior panel 22 located within the ridge 20. A mouth score 26 defines the peripheral boundary of the mouth panel 30. Another formed area or ridge 24 is shown as surrounding the mouth score 26 and located interiorly of the panel 22. Optionally, one or more additional formed areas or ridges 28 may be located on the mouth panel 30. The various formed areas/ridges provide additional strength for the container end, and it shall be understood that the number and configurations of these elements can be changed without departing from the present invention. Therefore, it will be understood that the particular arrangement shown in FIG. 1 is but one example of various formed areas/ridges that can be used.

Located at the center of the container end 10 is a rivet 38 that holds the rotatable tab to the container. The tab includes a handle end 32, a pressure applying end 34, and a body 36 interconnecting the ends. The tab further includes the characteristic semi-circular shaped opening 40 that enables a user to lift the handle end 32 of the tab, thereby placing the pressure applying end 34 in contact with the mouth panel 30. As shown, the semi-circular shaped opening 40 is oriented to partially surround the rivet 38. With adequate pressure applied, the mouth score 26 fails, enabling the mouth panel 30 to rotate inward towards the contents of the container, thereby forming the mouth opening.

The vent of the container end is defined by a raised vent panel 62 and a peripheral vent score 60 defining the peripheral edge of the vent panel 62. Force is applied against the raised vent panel 62 in order to break the vent score 60, thereby forming a vent opening. The vent panel 62 remains attached to the container end along vent bending line 64. The bending line 64 is not scored, but defines the area along which the vent panel 62 bends. In order to facilitate easier bending of the vent panel along this line 64, the vent panel may be dimpled along the line 64, such as by forming a crease that reduces the thickness of the panel. Optionally, the area located circumferentially exterior of the vent score 60, shown as edge 66, may be formed or creased in order to provide additional strength around the vent score 60 enabling it to more easily separate when force is applied against the vent panel 62.

Figure 2:
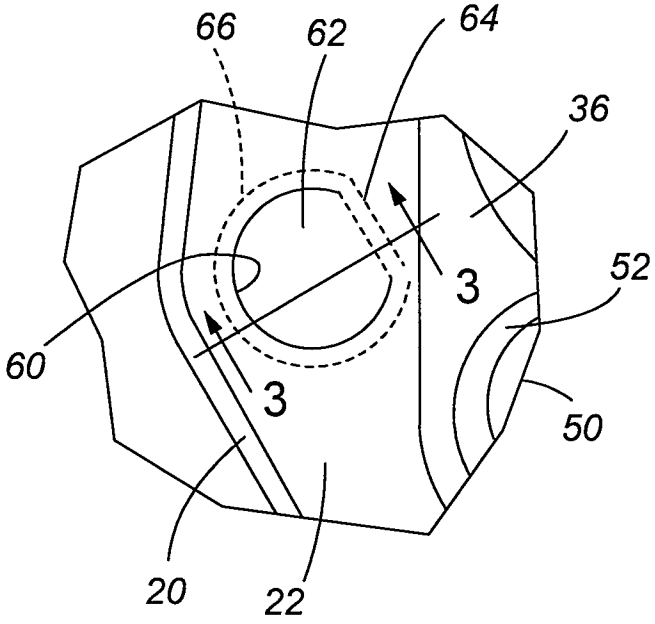
FIG. 2 is a greatly enlarged fragmentary plan view of the container lid showing the vent panel and vent score formed in the container lid.

FIG. 2 is an enlarged view of the vent, better illustrating the arrangement of the vent elements. The bending line 64 extends substantially perpendicular to a radial line extending from the center of the container lid at the rivet 38. The vent is circular or elliptical shaped in the FIG. 2, but the shape of the vent can be modified. When the tab is in its normal orientation, that is, aligned so that the end 34 is in position to contact the panel 30, the vent panel 62 is not covered by the tab. The vent panel 62 is located between one side edge of the tab and the bend or ridge 20. The vent panel is also shown as being located laterally offset from the tab as compared to the axis Y-Y, and between the rivet 38 and the handle end 32 of the tab. FIG. 1 illustrates the offset from the central axis Y-Y at an angle A. This angle A is shown in the preferred embodiment as being approximately 45 degrees. However the angle A can be in the range of between about 33 to 50 degrees.

Figure 3A:
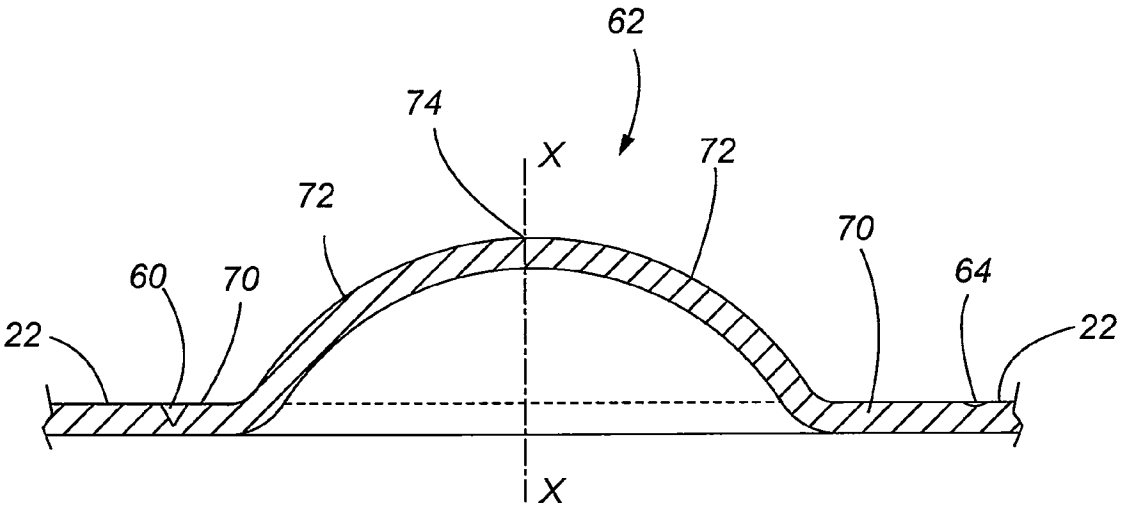
FIG. 3A is a cross-sectional view taken along line 3-3 of FIG. 2, showing a raised vent panel.

Referring to FIG. 3A, the convex shape of the raised vent panel 62 is illustrated. As shown, the vent score 60 is formed in the material and the circumferential edge 70 of the panel 62 may be flat or co-planar with the surrounding interior panel 22. A raised convex portion 72 lies within the circumferential edge 70. The convex portion 72 is shown as being symmetrical about center axis-X-X. The highest point on the raised convex portion 72 is shown as point 74 that intersects the center axis X-X.

Figure 3B:
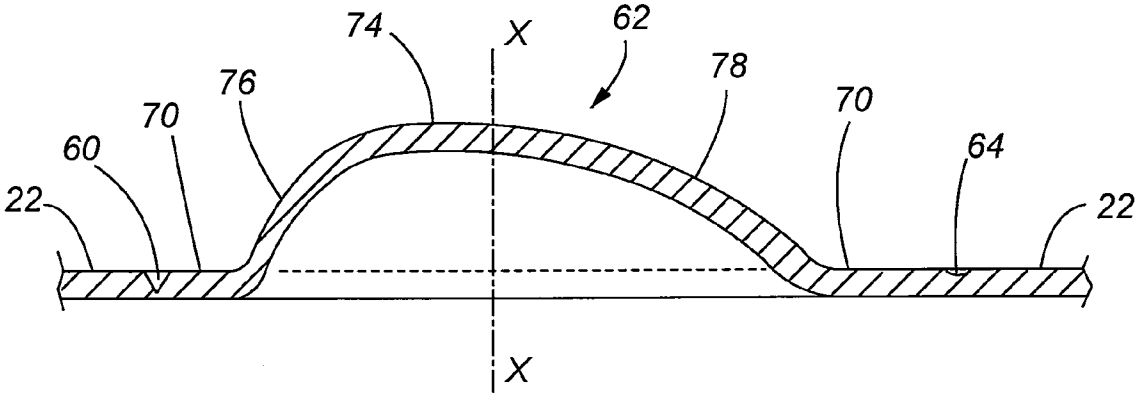
FIG. 3B is another cross-sectional view taken along line 3-3, but showing the raised vent panel in a different configuration.

Referring to FIG. 3B, an alternate embodiment is shown for the raised vent panel 62. The vent panel 62 is not symmetrical about the center axis X-X-, but rather is skewed or shifted to one side of the center axis. More specifically, the vent panel 62 has the flat circumferential edge 70, but the symmetrical convex shape is replaced with an asymmetrical protrusion having a steeper sloping side 76, and a more gradual sloping slide 78. In the example of FIG. 3B, the steeper sloping side 76 would be located closest to the portion of the vent score 60 opposite the vent bending line 64 when viewing FIG. 2. Pressure applied by the tab against the raised vent tab would first break the score at this location, which may be advantageous in creating the vent opening. However, it shall be understood that asymmetrical shaped vent panel 62 shown in FIG. 3B could be configured so that the steeper sloping side 76 is located closer to any selected location around the vent score 60 in order to thereby manipulate the breaking of the vent score in a controlled manner.

Figure 4:
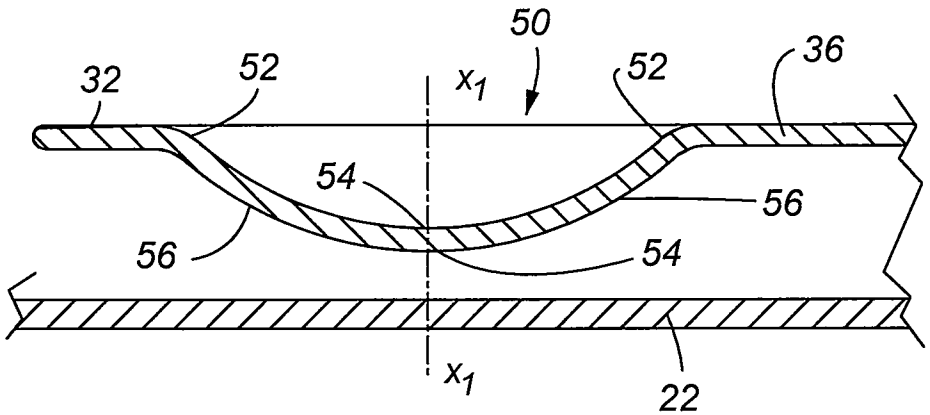
FIG. 4 is an enlarged cross-sectional view taken along line 4-4 of FIG. 1.

Referring to FIG. 4, a cross-sectional view is shown of the concave formed area 50 of the tab. The concave area 50 is characterized by a gradual circumferential sloping edge 52 that transitions into a symmetrical curved portion 56 terminating at a lowest point 54. The concave area 50 is symmetrical about the axis $X_1$-$X_1$, and the lowest point 54 intersects this axis $X_1$-$X_1$. Preferably, the concave area 50 extends continuously between lateral side edges of the handle end 32 of the tab and extends continuously between the rear edge of the handle end 32 and the more forward portion of the handle end 32 adjacent the semicircular shaped opening 40.

Figure 5:
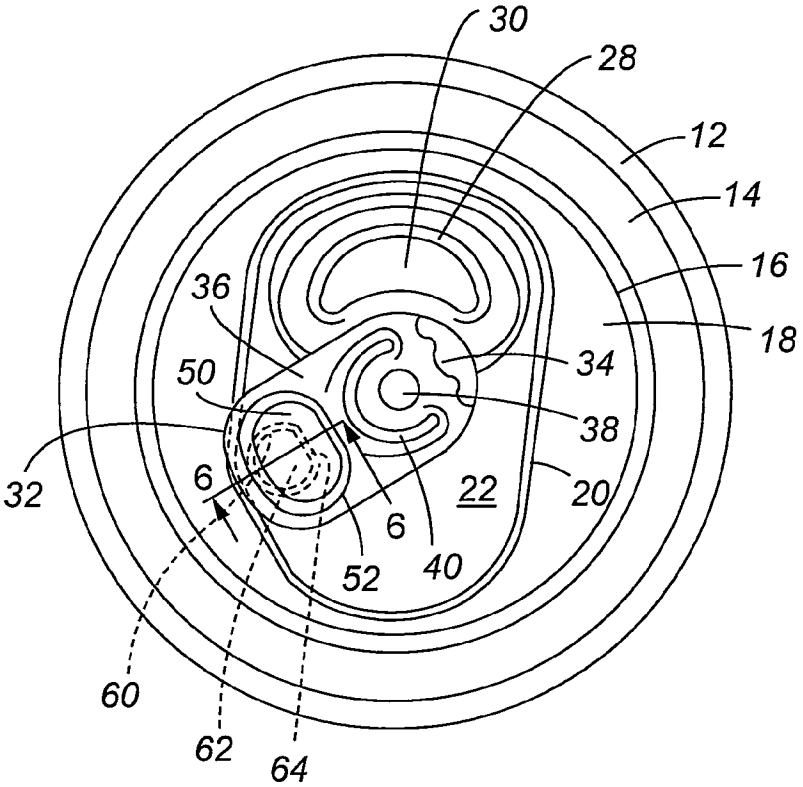
FIG. 5 is another plan view of the container lid, illustrating the tab rotated so that the handle end of the tab covers the vent panel.
Figure 6:
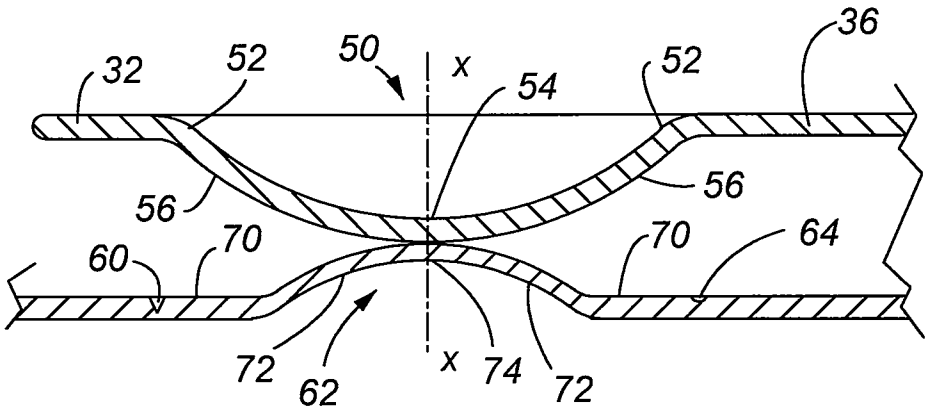
FIG. 6 is an enlarged cross-sectional view taken along line 6-6 of FIG. 5.

When the user wishes to open the vent, the user may rotate the tab as shown in FIG. 5 so that the concave area 50 is centered over the raised vent panel 62. Referring to specifically to FIG. 6, the concave area 50 is centered over the vent panel 62. Pressure applied downwardly against the tab results in contact of the concave area 50 against the vent panel 62. With adequate force, the vent score 60 is broken, thereby creating a vent opening for the container. As shown in FIG. 6, one preferred embodiment includes alignment of the vent panel 62 with the concave area 50 so that both are symmetrical about the axis X-X.

Figure 7:
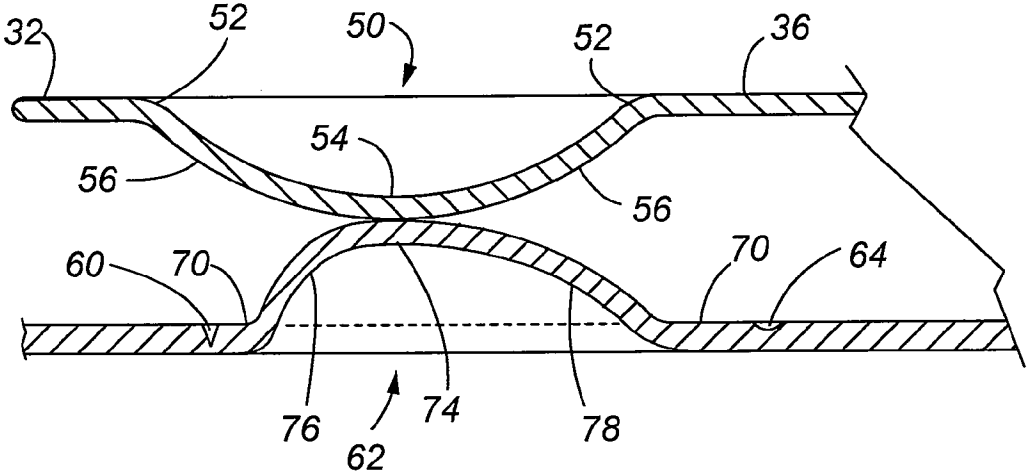
FIG. 7 is another enlarged cross-sectional view similar to FIG. 6, but showing the configuration of the raised vent panel illustrated in FIG. 3B.

Referring to FIG. 7, the asymmetrical raised vent panel 62 of FIG. 3B is illustrated. The lowest point 54 of the concave area 50 makes contact with the skewed or shifted location of the highest point 74 of the vent panel 62. According to this Figure, a greater amount of the initial force transferred from the tab to the vent panel 62 would be concentrated along the portion of the score 60 closest to the steeper side 76 of the vent panel. Thus, one advantage of providing an asymmetrical-shaped vent panel 62 is that force may be directed to be concentrated along any portion of the vent score 60 in order to controllably commence breakage of the score to create the vent opening.

Figure 8:
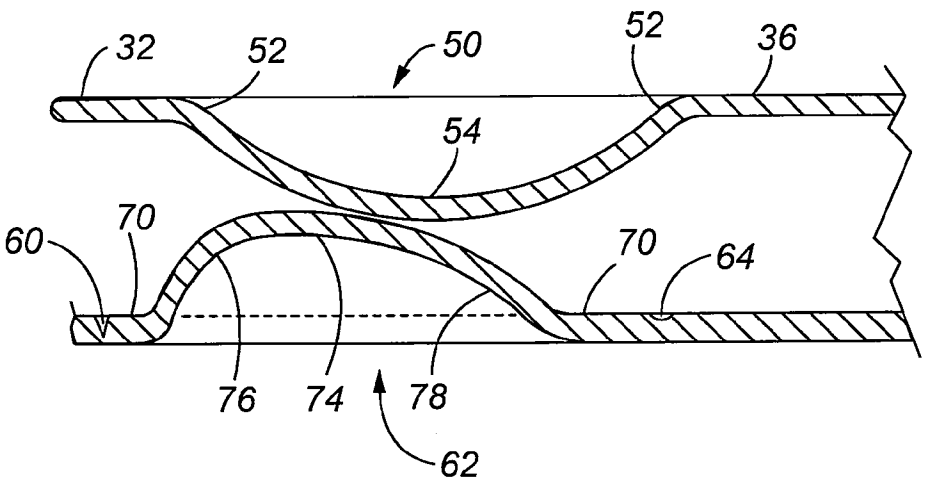
FIG. 8 is another enlarged cross-sectional view similar to FIG. 7, but the handle end of the tab being shifted as compared to the location of the tab in FIG. 7 so the vent panel and concave area contact one another at a different location.

Referring to FIG. 8, another embodiment is shown in which the concave area 50 of the tab is shifted to the right and therefore, does not contact the raised vent panel 62 at the highest point 74, but rather, contacts the vent panel 62 along the gradual sloping side 78. Shifting of the tab in this manner can be achieved either by shortening the length of the tab handle end 32 or moving the location of the vent panel 62 radially outward from the center of the container end. With the arrangement shown in FIG. 8, yet a different type of breakage will occur along the score 60 that may be more advantageous for a particular type of tab used, as well as other factors in the overall design of the container lid.

Figure 9:
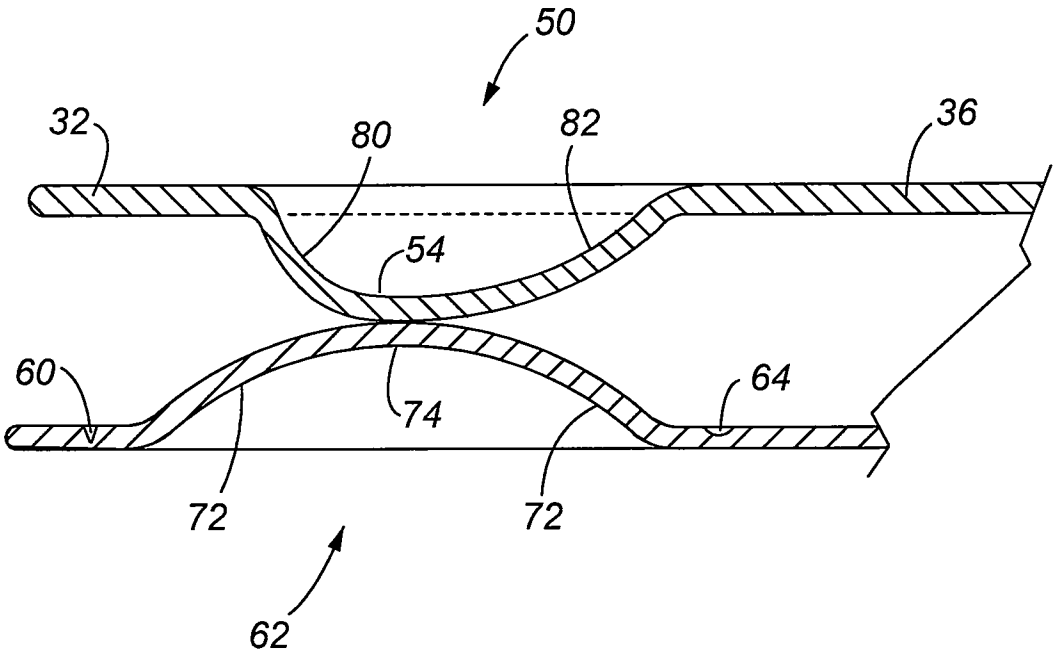
FIG. 9 is another enlarged cross-sectional view similar to FIG. 7, but the shape of the concave area is modified in an additional embodiment to control force applied to the vent panel, while the raised vent tab maintains a symmetrical shape.

Referring to FIG. 9, yet another embodiment is shown in which the shape of the concave area 50 is changed to accommodate a controlled direction and location of applied force. In this Figure, the vent panel 62 is a symmetrical shaped convex raised area while the concave area is asymmetrical having a steeper sloping side 80 and a more gradual sloping side 82. Thus, with this arrangement, the application of force can be controlled with the preselected shape of the concave area 50. It is further contemplated that both the vent panel 62 and the concave area 50 can be asymmetrically shaped in order to control the direction and location of applied force. The advantageous configuration of the raised vent panel and the protruding vent panel provide a great number of options for fine control of force applied to break the vent score.

With the combination of the raised vent panel along with the concave-formed area on the tab, an effective structure is provided for creating a vent opening in the container lid. The vent opening may also be created by use of some other implement to push in the vent panel. One readily apparent advantage of the present invention is that the user does not have to use the hand to create the vent opening, which may otherwise create a safety concern by contact of the user's hand with the exposed edge of the container end surrounding the vent panel. The force multiplying attribute of the concave formed area of the tab provides an effective tool for creating the vent opening.

According to the method of the present invention, a user may first create the mouth opening and then the vent opening, or vice versa. When the vent is to be opened, the user may take advantage of the force multiplying feature in the concave area of the tab. Rotation of the tab and alignment of the handle end of the tab to cover the vent panel provides an optimum position for applying force to contact the vent panel.

The method also involves selected force transfer by the tab to the raised vent panel by shaping the vent panel so that the highest point on the vent panel is located closest to the desired location where vent score breakage is to occur. The method also contemplates controlled and directed application of force by configuring the location where the concave portion of the tab contacts the raised vent tab. Either the vent panel or the concave portion of the tab, or both, may be shaped to control and direct the application of force.

Although the invention has been described with respect to preferred embodiments, it shall be understood that various changes and modifications may be made considering the teachings of the invention as a whole, and taking into consideration the scope of the claims appended hereto.

What is claimed is:

1. A container lid comprising:

a peripheral rim for connecting to a body of a container;

a main panel formed interiorly of the peripheral rim, the main panel including an asymmetrical depressed interior panel;

a mouth panel formed on the depressed interior panel of the main panel and having a peripheral outer edge defined by a mouth score;

a rotatable tab connected to the depressed interior panel of the main panel by a rivet located at a center of the container lid; said tab including a handle end, a pressure-applying end, and a body interconnecting the handle end and the pressure-applying end, a vent panel formed on the depressed interior panel of the main panel and spaced from the mouth panel and spaced from the tab while the tab is in position to actuate the mouth panel, said vent panel having a peripheral outer edge defined by a score line and said vent panel having a raised convex interior portion, the raised convex interior portion being uncovered by the tab when the tab is rotationally oriented for opening the mouth panel, the raised convex interior portion being covered by the tab when the tab is rotationally oriented for opening the vent panel.

2. A lid, as claimed in claim 1, wherein: said handle end of the tab includes a concave formed area and a lowest point located interiorly of the periphery said concave formed area on said tab is symmetrical about an axis.

3. A lid, as claimed in claim 1, wherein: said vent panel is symmetrical about an axis.

4. A lid, as claimed in claim 1, wherein: said vent panel is asymmetrical shaped, including at least one steeper side, and one gradual sloping side.

5. A lid, as claimed in claim 1, wherein: said handle end of the tab includes a concave formed-area and said tab is rotated to align the concave formed area with the vent panel, and a lowest point on the concave formed area contacts a highest point on the raised convex interior portion of the vent panel.

6. A lid, as claimed in claim 1, wherein: said handle end of the tab includes a concave formed-area and said tab is rotated to align the concave formed area with the vent panel, and the concave formed area contacts a point on said vent panel other than the highest point on the raised convex portion of the vent panel.

7. A lid, as claimed in claim 1, wherein: said handle end of the tab includes a concave formed-area and said concave formed area is asymmetrical shaped, including at least one steeper side, and one gradual sloping side.

8. A lid, as claimed in claim 1, wherein: said vent panel is asymmetrical shaped.

9. A lid, as claimed in claim 1, wherein: said handle end of the tab includes a concave formed-area and said concave formed area is asymmetrical shaped.

10. The container lid of claim 1 wherein the tab body is defined by approximately parallel sides, the vent panel being located outside of the tab body sides when the vent panel is uncovered, the vent panel being located between the tab body sides when the vent panel is covered.

11. A lid, as claimed in claim 1, wherein: said vent panel is located at an angle from a line passing through a geometric center of the container lid.

12. A lid, as claimed in claim 11, wherein: said angle is between about 35 to 50 degrees.

13. A method of opening a container and venting the container, comprising the steps of:

for a container package having a lid that includes:

(i) a peripheral rim for connecting to a container body;

(ii) a main panel formed interiorly of the peripheral rim, the main panel including an asymmetrical depressed interior panel;

(iii) a mouth panel formed on the depressed interior panel of the main panel and having a peripheral outer edge defined by a mouth score;

(iv) a rotatable tab connected to the depressed interior panel of the main panel by a rivet located at a center of the container lid; said tab including a handle end, a pressure-applying end, and a body interconnecting the handle end and the pressure-applying end; and (v) a vent panel formed on the depressed interior panel of the main panel and spaced from the mouth panel and spaced from the tab, said vent panel having a peripheral outer edge defined by a score line and said vent panel having a raised convex interior portion;

lifting the handle end of the tab upward to force the contact the pressure-applying end downward against the mouth panel thereby breaking the mouth score and creating a main opening;

rotating the tab about the rivet to align the handle end of the tab with the vent panel; and pushing down on the tab to cause a concave formed area of the tab to contact the vent panel, thereby breaking the vent score and creating a vent opening.

14. A method, as claimed in claim 13, wherein: said handle end of the tab including a concave formed area, and said concave formed area having a substantially circular periphery, and a lowest point located interiorly of the periphery, said concave formed area on said tab is symmetrical about an axis.

15. A method, as claimed in claim 13, wherein: said vent panel is symmetrical about an axis.

16. A method, as claimed in claim 13, wherein: said vent panel is asymmetrical shaped, including at least one steeper side, and one gradual sloping side.

17. A method, as claimed in claim 13, wherein: said tab is rotated to align the concave formed area with the vent panel, and a lowest point on the concave formed area contacts a highest point on the raised convex interior portion of the vent panel.

18. A method, as claimed in claim 13, wherein: said tab is rotated to align the concave formed area with the vent panel, and the concave formed area contacts a point on said vent panel other than the highest point on the raised convex portion of the vent panel.

19. A method, as claimed in claim 13, wherein: said concave formed area is asymmetrical shaped, including at least one steeper side, and one gradual sloping side.

20. A method, as claimed in claim 13, wherein: said vent panel is asymmetrical shaped.

21. A method, as claimed in claim 13, wherein: said concave formed area is asymmetrical shaped.

22. The method of claim 13 wherein the tab body is defined by approximately parallel sides, the vent panel being located outside of the tab body sides when the vent panel is uncovered, the vent panel being located between the tab body sides when the vent panel is covered.

23. A method, as claimed in claim 13, wherein: said vent panel is located at an angle from a line passing through a geometric center of the container lid.

24. A method, as claimed in claim 23, wherein: said angle is between about 35 to 50 degrees.

* * * * *